US006128835A

United States Patent [19]

Ritter et al.

[11] Patent Number: 6,128,835

[45] Date of Patent: Oct. 10, 2000

[54] SELF ADJUSTING FRAME FOR FOOTWEAR

[75] Inventors: Brett D. Ritter; Damon R. Butler; Barry Joseph McGeough, all of Santa Barbara, Calif.

[73] Assignee: Mark Thatcher, Flagstaff, Ariz.

[21] Appl. No.: 09/239,473

[22] Filed: Jan. 28, 1999

[51] Int. Cl.[7] ..... A43B 5/00

[52] U.S. Cl. ..... 36/45; 36/50.1; 36/114

[58] Field of Search ..... 36/50.1, 89, 114, 36/45

[56] References Cited

U.S. PATENT DOCUMENTS

| | | | |
|---|---|---|---|
| 3,703,775 | 11/1972 | Gatti | 36/50.1 |
| 5,271,130 | 12/1993 | Batra | 36/50.1 |
| 5,291,671 | 3/1994 | Caberlotto et al. | 36/50.1 |
| 5,463,822 | 11/1995 | Miller | 36/50.1 |
| 5,467,537 | 11/1995 | Aveni et al. | 36/50.1 |
| 5,497,564 | 3/1996 | Allen et al. | 36/50.1 |
| 5,511,325 | 4/1996 | Hieblinger | 36/50.1 |
| 5,564,203 | 10/1996 | Morris | 36/50.1 |
| 5,651,195 | 7/1997 | Clancy | 36/50.1 |
| 5,659,982 | 8/1997 | Muraoka et al. | 36/50.1 |
| 5,909,946 | 6/1999 | Okajima | 36/50.1 |

*Primary Examiner*—M. D. Patterson
*Attorney, Agent, or Firm*—Snell & Wilmer L.L.P.

[57] ABSTRACT

A self adjusting frame for footwear comprises a strap slideably passing through a plurality of connectors spaced apart and adjacent to the sole, the strap passing around the heel of the footwear and having its two ends connected to the footwear. Lacing crosses over the footwear upper, with the lacing slideably engaging the strap so that when the lacing is tightened the strap is likewise drawn tight. The lacing and strap combination thereby secures footwear to a foot about substantially the periphery of the foot, and further self adjusts to develop differently oriented foot securing force vectors for differently shaped feet. Footwear comprises lacing and a strap passing through a plurality of connectors spaced apart around a shoe, with the lacing slideably engaging the strap. As the lacing is tightened the strap is thereby drawn tight. The footwear is thus secured to a foot about substantially the periphery of the foot.

11 Claims, 2 Drawing Sheets

SELF ADJUSTING FRAME FOR FOOTWEAR

FIELD OF THE INVENTION

The present invention relates to footwear, and particularly to closure systems for securing footwear to a wearer's foot.

BACKGROUND OF THE INVENTION

Footwear generally comprises a sole and an upper attached to the sole which surrounds the foot. The upper is removably and adjustably secured to the foot with lacing, which generally crosses back and forth in a crisscross manner over the instep between eyelets in the lateral and medial sides of the upper. As the lace is tightened, the eyelets and hence the medial and lateral sides of the upper are pulled together and tightened.

The upper body of such prior art footwear is often not adjustable except for the laces across the front of the foot. These laces offer only limited adjustment, particularly for regions of the upper that are relatively remote from the laced area, such as the heel, ankle, and forefoot. Such limited adjustment is disadvantageous.

Footwear adjustability is further limited by the fixed location of the eyelets. The location of the lacing determines the location and direction of force vectors developed to secure the foot. While the location of the eyelets may be appropriate for a particular foot, they may not be for a different foot. As there are an infinite variety of foot shapes, fixed location lacing eyelets is hence undesirable. Eyelets are typically rings made of metal or plastic that are affixed to the footwear upper. Such metal or plastic construction is susceptible to breakage, and is known to occasionally separate from the upper under strain of the lacing.

The location of the lacing may also result in user discomfort. As the lacing typically is the only means for adjusting and securing the shoe to the foot, excess tension may be imparted in the laces, and in the upper closely adjacent to the laces. This can result in a disadvantageous compression of the upper on the wearer's instep where the main foot circulatory channels are located, leading to poor circulation through the foot and resultant discomfort.

Also, conventional instep lacing location does not address common problems in retaining a wearer's heel in the footwear. The heel tends to lift and disengage from a sole and from the footwear as the heel is lifted during a wearer's forward movement. This may be particularly true during activities such as sports where very rapid forward movements occur, or when hiking up a steep incline. Traditional instep lacing offers limited means to provide heel retaining support.

Conventional lacing is connected to the sole of the footwear through the medial and lateral quarters of the upper. To offer maximum structural support, these portions of the upper, and in many cases the entire upper, are constructed of heavy weight, high strength materials such as leather, thick canvasses, or heavy synthetic materials. In addition to increasing the weight of the footwear, these materials disadvantageously prevent air circulation. This causes the footwear interior to be uncomfortably hot and humid. For footwear that may be used in a wet environment, such as use during water sports, such heavy uppers disadvantageously do not allow for drainage. Further, heavy materials disadvantageously increase the weight of the footwear.

Also, the upper often loosens over time and with use. As the foot is inserted and removed from the upper, the upper materials may be stretched. After repeated stretchings, the upper will loosen and over time the fit will degrade.

There is therefor an unresolved need for improved footwear having a lacing system for secure attachment of a user's foot to the footwear.

OBJECTS OF THE INVENTION

It is an object of the invention to provide a self adjusting frame for securely and removably attaching the footwear to a wearer's foot.

It is a further object of the invention to provide footwear having an upper that distributes foot retaining forces over a substantial area of the foot, thereby relieving pressure on the instep.

It is a further object of the invention to provide footwear having a maximum area of porous panels for breathability and passage of water.

It is a further object of the invention to provide footwear that maximizes stability and support with a minimum of weight.

It is a further object of the invention to provide footwear that provides for improved heel retention.

SUMMARY OF THE INVENTION

The present invention comprises a self adjusting frame for securely and removably attaching footwear to a wearer's foot. The present invention further comprises footwear incorporating the self adjusting frame of the invention.

The invention comprises a self adjusting frame for removably securing a footwear sole to a wearer's foot. The invention provides footwear with maximum performance in areas of fit and breathability, and further maximizes wearer stability and support while minimizing weight. A preferred self adjusting frame generally comprises a plurality of connectors adjacent to the sole that are spaced apart from one another along the medial and lateral sides of the footwear. The connectors are connected to the sole with posts or other structural members. A strap slideably passes through the connectors and encircles the wearer's foot. Closure means, preferably lacing, engage lateral and medial portions of the strap at a plurality of engagement points.

Tightening of the lacing or other closure means thus draws the strap tight, which in turn pulls the sole towards the foot. Drawing the strap tight further causes the strap to snugly compress substantially the entire perimeter of the footwear upper and to thereby close the footwear on a wearer's foot. Further, the plurality of engagement points where the lacing and strap engage one another may adjust and shift in response to differently shaped feet, and to the changing shape of a wearer's foot. In this manner the lace and strap of the present invention in combination form a self adjusting frame which automatically self-adjusts to provide a custom fit. This provides a much improved footwear attachment over conventional lacing systems of the prior art.

The footwear of the invention has a sole and an upper. The upper has a medial side, a lateral side, a heel cup, and a forefoot. A plurality of spaced apart connectors are adjacent to and connected to the sole, with a strap slideably engaging the connectors and passing along the medial side, heel, and lateral side of the footwear. Lacing passes back and forth over the instep of the upper. The lacing slideably engages the strap at a plurality of engagement points along the footwear medial and lateral sides. Alternatively other closure means could be used in lieu of the preferred lacing.

As with the self adjusting frame of the invention, tightening of the lacing of the footwear of the invention results in a tightening of the strap. The sole of the footwear is pulled towards a wearer's foot, and substantially the entire perimeter of the body is snugly compressed against the wearer's foot. The heel portion of the upper is urged forward to securely capture and retain the wearer's heel, and to thus reduce the tendency of the heel to disengage. The lace and strap of the invention thus combine to secure the footwear to a wearer's foot and to distribute related closure forces around substantially the entire periphery of the wearer's foot.

Further, the plurality of engagement points where the lacing and strap slideably engage one another are free to adjust and shift in response to changes in foot shape. Different people have different feet. Further, each person's feet may change over time. Indeed, the size and shape of a person's foot may change during the course of a day. Further, through use and aging, the shape of the footwear may change somewhat. The footwear of the present invention responds to such changes by self adjusting to the particular foot or footwear shape. A constantly self adjusting, custom fit is thereby provided. This provides much improved securing to a foot over footwear of the prior art.

The footwear of the invention may preferably further comprise a plurality of mesh panels facilitating breathability and drainage of water. As the primary foot securing structural loads are carried by the lace and strap, the upper of the footwear may comprise a plurality of lightweight, breathable, porous mesh panels. Portions of the upper may likewise be open. This offers advantage in the use of the preferred footwear of the invention for breathability; and for use in activities which may involve exposure to water, such as use on watercraft.

By carrying the foot retaining related tensions through the lacing and the strap of the invention, the need for a heavy weight, structural upper is also eliminated. This desirably allows for the footwear of the invention to be constructed of substantially light weight materials without any sacrifice of structural stability or support.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation. For instance, the footwear of the invention may include, but are not limited to, running shoes, court shoes, deck shoes, sandals, boots, skates, ski boots, and the like.

DETAILED DESCRIPTION

Figure 1:
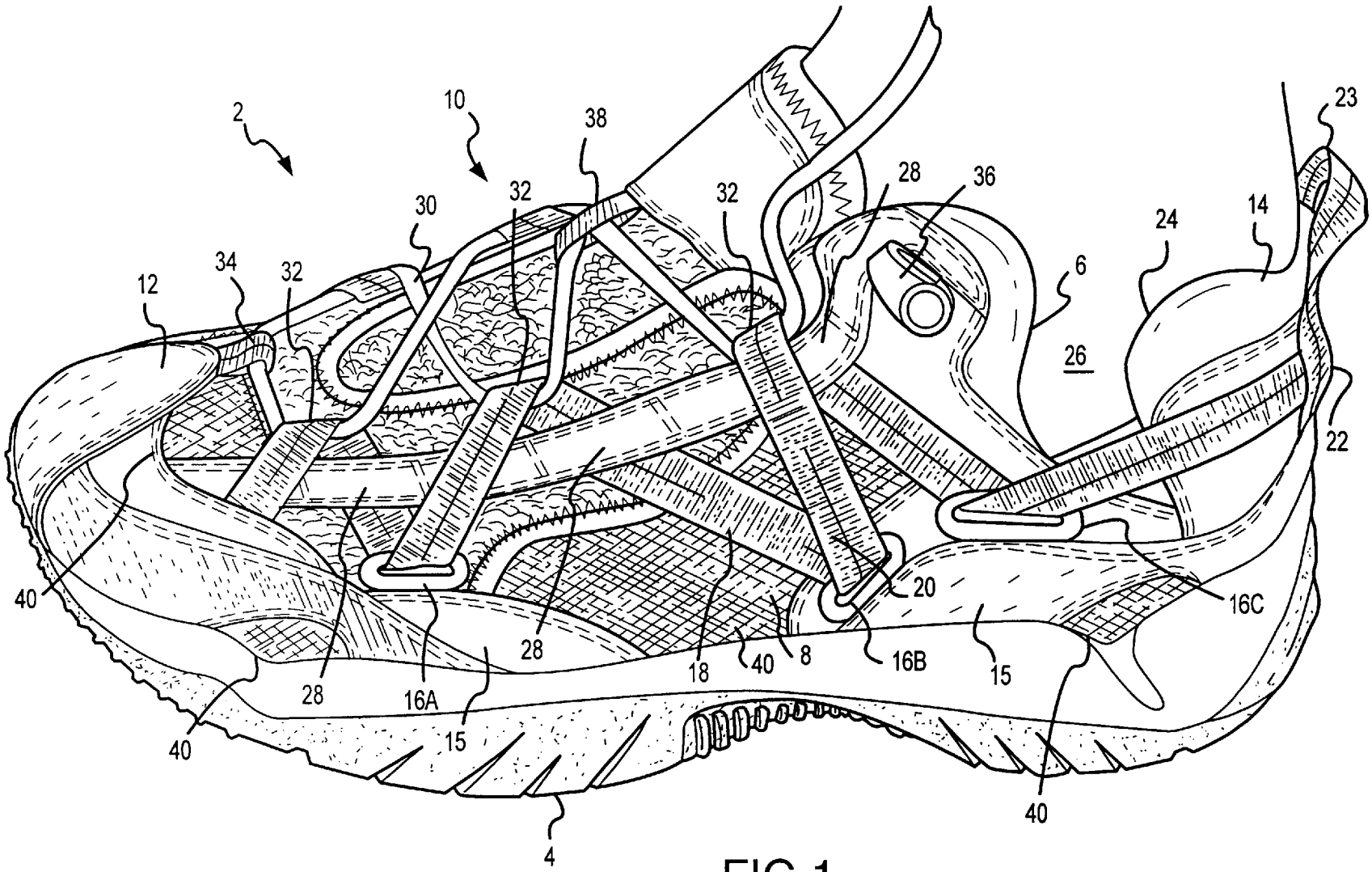
FIG. 1 is a medial perspective view of a preferred embodiment of the footwear of the invention.
Figure 2:
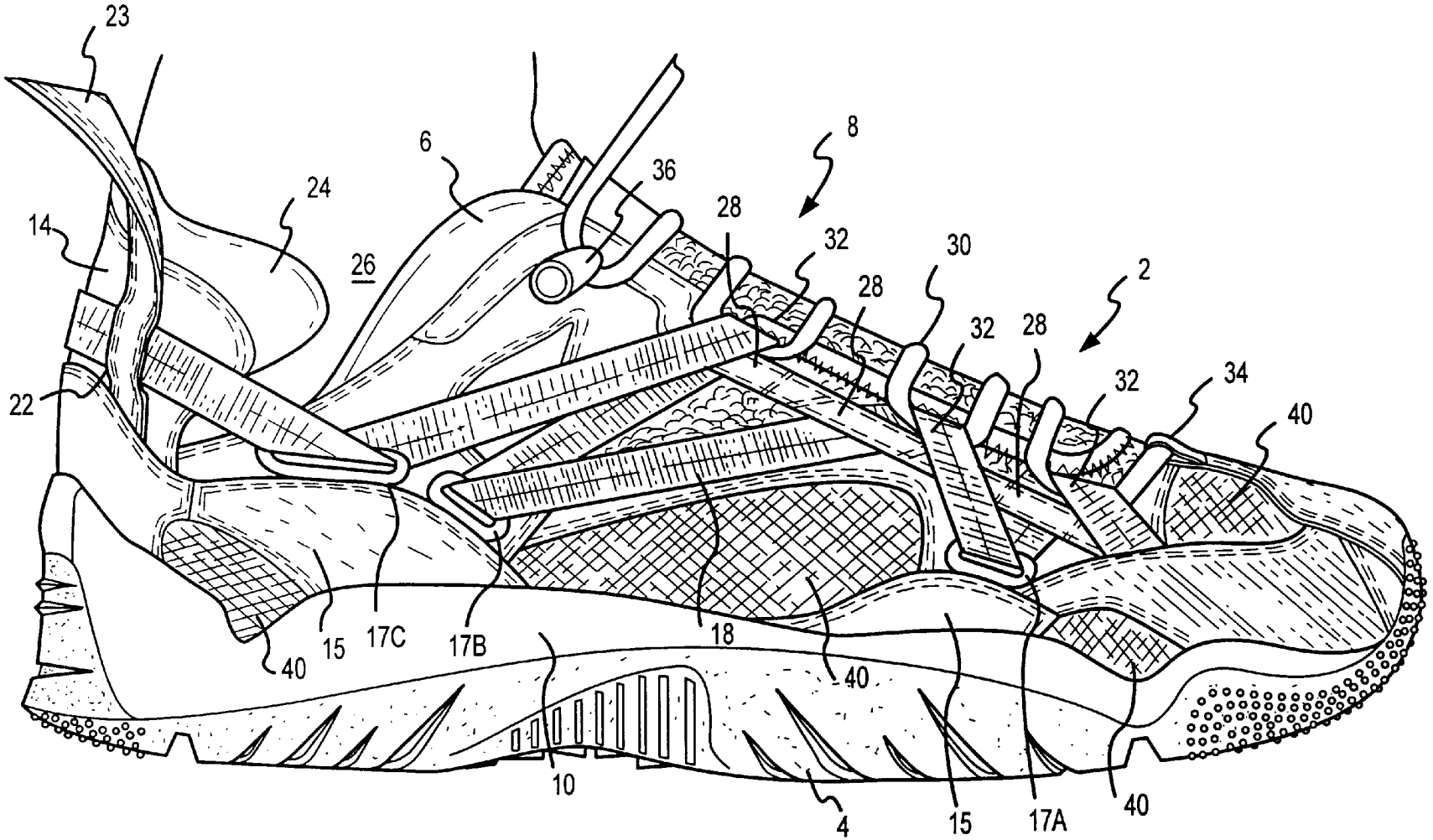
FIG. 2 is a lateral elevational view of the preferred embodiment of the footwear of the invention.

Turning now to the drawings, FIG. 1 is a medial perspective view of a preferred embodiment of the footwear 2 of the invention having a self adjusting frame. FIG. 2 is a lateral elevational view of the preferred footwear. Footwear 2 comprises sole 4 and upper 6. Upper 6 has medial side 8, lateral side 10, forefoot 12, and heel 14. A plurality of posts 15 hold a respective plurality of spaced apart medial side connectors 16A, 16B, and 16C. Likewise, a plurality of spaced apart lateral side connectors 17A, 17B, and 17C are held on posts 15. Posts 15 connect and link connectors 16, 17 to sole 4. Connectors 16, 17 are preferably comprised of a strong, lightweight material such as molded nylon, and preferably are loop or ring shaped. A strap 18 extends substantially around the periphery of footwear 2, and slideably engages connectors 16, 17. Strap 18 preferably comprises a continuous loop, passing through footwear forefoot 12, either below or above the wearer's foot. Strap 18 may slide in a passageway through forefoot 12, but preferably is fixed in place by stitching or other means to prevent movement within forefoot 12. Alternatively, strap 18 may have two ends attached, respectively, to upper lateral side 10 and medial side 12. For structural reasons, a continuous strap 18 is preferred. As an alternative to the continuous strap 18 illustrated in FIGS. 1 and 2, strap 18 may comprise two separate straps extending along the medial and lateral sides of the footwear.

Strap 18 is preferably comprised of a substantially non-elastic hydrophobic material. This preferred construction insures that strap 18 will withstand exposure to water without substantial deformation, while its non-elastic condition provides for a long life without elongation. Preferred strap 18 comprises substantially flat webbing, with a width such to provide low friction movement through connectors 16, 17.

Heel portion 14 of upper 6 has a pair of guides 22, one medial and one lateral, for slideably receiving strap 18. Preferred guides 22 are formed by looped portions of leather strip 23 attached to the heel and extending continuously to form a pull loop for pulling the footwear on. Heel 14 includes padded upper wing 24 for comfortably engaging the recessed portion of a wearer's foot lying just above a wearer's calcaneus. Further, gap 26 separates heel 14 from the rest of upper 6 to allow for movement of heel 14 towards upper 6. Heel 14 may comprise additional padding to prevent strain on a wearer's Achilles' tendon.

The preferred footwear 2 further comprises a plurality of lateral and medial stays 28 for slideably guiding strap 18. Stays 28 help to orient strap 18 and to limit its cross direction movement. Stays 28 are preferably comprised of a continues leather or polymer strip sewn or otherwise attached to upper 6, with raised, unattached sections forming stays 28. Alternate stays 28 may be of molded polymer construction. Stays 28 are preferably sized such that strap 18 freely passes through, and such that strap 18 has some freedom of cross direction movement.

Lacing 30 crosses back and forth over the upper instep. Lacing 30 engages strap 18 at a plurality of engagement points 32 along upper medial side 8 and along upper lateral side 10. Preferred lacing 30 is comprised of a substantially non-elastic, hydrophobic material. Such preferred construction allows for lacing 30 to be used effectively in wet environments, and allows for a long service life as lacing 30 does not lose elasticity with age and strain as occurs with elastic materials.

Alternate closure means may be provided in lieu of lacing 30. For example, three or four individual Velcro straps could be used to adjustably span between engagement points 32 and close the footwear. Mechanical closure means, such as buckles or the like, could also be used.

As a result of their interaction at engagement points 32, when lacing 30 is tightened, strap 18 is drawn tight. This results in connectors 16, 17, posts 15, and in turn sole 4 being urged towards the wearer's foot. Also, heel 14 is urged or drawn forward to securely capture a wearer's heel, which discourages the heel from lifting or otherwise separating from footwear 2 during use.

Thus the footwear is secured to a wearer's foot about substantially the entire periphery of the foot. Also, forces associated with retaining a foot in the footwear are carried by lacing 30 and strap 18, and are thus distributed about substantially the entire periphery of footwear 2. This advantageously prevents those forces from being concentrated above the foot instep where the main foot circulatory channels are located.

Further, because strap 18 and lacing 30 are not statically fixed in location, but are instead oriented by engagement points 32, they are free to shift and adjust position to provide a custom fit for a particular wearer's foot. When the footwear of the invention is fitted on a foot that has a high instep, for instance, tightening of lacing 30 will result in engagement points 32 shifting location as compared to their position when a foot having a flatter instep is fitted. Further, as a user wears the footwear 2 through the day and a variety of activities, engagement points 32 will likewise shift as the shape of the foot changes. Likewise, changes in the shape of footwear 2 that may occur over time and with wear will be accommodated for by adjustments of engagement points 32.

In essence, strap 18, lacing 30, and engagement points 32 "float" over footwear 2 to best fit a foot. The force vectors associated with securing a foot in the footwear of the invention are thus self adjusted and directed. This is an important improvement over fixed position eyelets or other fixed closure means. Further, the footwear of the invention with its engagement points 32 does not depend on metal or plastic eyelets which may break, or detach from the upper.

Preferred anchor sleeve 34 is connected to forefoot 12 and thus to sole 4, and slideably receives lacing 30. Lacing 30 is thereby connected to the front of sole 4 for further distribution of foot retaining tensions, and for tighter control of the front portion of the sole. An optional eyelet 36 is located on the lateral 10 and medial side 8 of the upper for slideably receiving lacing (lacing 30 is not illustrated passing through eyelet 36 in FIG. 1). Eyelet 36 is preferably of a durable, rotating type. The rotatable mounting of eyelet 36 allows for a greater freedom of movement of lacing 30. Lacing 30 may also be guided by optional tongue guide 38, which loosely guides lacing 30.

Because foot securing tensions are born by lacing 30 and strap 18, the footwear upper need not be constructed of heavy weight materials as might otherwise be required. This allows for the preferred footwear upper to desirably provide a maximum of stability and support while minimizing its weight, and to further comprise a plurality of panels 40 comprised of porous, breathable mesh. Panels 40 allow water to pass from the footwear interior, and provide improved breathability. The preferred footwear of the present invention is thus particularly well suited for use in water sports, and for activities where feet tend to become hot and/or perspire. The upper may make use of heavier weight, more substantial materials such as leather for posts 15, and for forefoot 12 to provide good support, linkage to the sole of the footwear for connectors 16, 17 and anchor sleeve 34, and for good durability. Posts 15 and forefoot 12, however, could comprise strong, yet light weight materials, such as nylon webbing.

Location of connectors 16, 17 will affect the control a wearer's foot has over the footwear. A preferred location of connectors 16, 17 is illustrated in FIG. 1 and FIG. 2. Connector 16A and connector 17A are slightly forward of the metatarsal heads of the wearer's foot. This location of connectors 16A and 17A desirably allows them to effectively capture and carry forces associated with forward motion of the wearer's foot relative to the footwear. Lateral connector 16B and medial connector 17B are in the midfoot region forward of the wearer's ankle. Connectors 16B, 17B are angled to direct strap 18 towards the instep of upper 6 to provide even spacing between engagement points 32, and to avoid directing strap 18 over open mesh panels 40 on the lateral and medial quarters of upper 6. Lateral connector 17C and medial connector 16C are behind connectors 16B, 17B below the wearer's ankle. The strap 18 thereby is directed in an up and down, ricochet pattern across the medial side 8 and lateral side 10 of footwear 2. This connector location configuration has been found to be beneficial for the location and direction of resultant foot retaining force vectors.

In addition to the preferred connector location illustrated in FIGS. 1 and 2, other connector location configurations are of course possible and are within the scope of the invention as defined by the appended claims. It is noted, for example, that other embodiments of the invention may comprise more or fewer connectors located in different positions. Further, it is not intended that the invention be limited to transversely symmetrical connector placement. It may in fact be desirable to orient connectors asymmetrically on the lateral and medial sides, for instance, as desired to accommodate forces developed during court sports.

The advantages of the disclosed invention are thus attained in an economical, practical, and facile manner. While a preferred embodiment has been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A footwear product comprising:

a footwear producing having a sole, lateral and medial sides, and forefoot and heel regions; and a self-adjusting frame comprising:

a) a plurality of spaced apart connectors connected to said lateral side of said footwear;

b) a plurality of spaced apart connectors connected to said medial side of said footwear;

c) a medial strap portion extending along said medial side of said footwear, a lateral strap portion extending along said lateral side of said footwear, said strap portions on each side slideably engaging said connectors on each respective side, wherein said medial and lateral strap portions comprise a single continuous strap extending around said medial side, heel, and said lateral side of said footwear; and d) closure means between said lateral and medial portions of said strap, said closure means engaging said medial and lateral strap portions at a plurality of strap engagement points, whereby tightening of said closure means draws said medial and lateral strap portions tight, causing said medial and lateral strap portions to close around substantially the periphery of a wearer's foot.

2. A self adjusting frame for footwear as in claim 1, wherein said closure means comprises lacing crossing over the instep and engaging said medial and lateral strap portions.

3. A self adjusting frame for footwear as in claim 2, further comprising a heel portion attached said footwear, said heel portion having at least one guide thereon, said strap slideably received by said at least one guide, whereby said heel portion if urged forward upon said strap tightening.

4. A self adjusting frame for footwear as in claim 2, further comprising an anchor sleeve connected to the forefoot of said footwear, said lacing slideably passing through said sleeve.

5. A self adjusting frame for footwear as in claim 1, wherein a) each of said plurality of strap engagement points are located between adjacent ones of said connectors so that respective said lateral and medial strap portions each have an up and down ricochet pattern between said connectors and said engagement points; and b) said plurality of engagement points self adjust upon tightening of said closure means and during use of the footwear.

6. A self adjusting frame for footwear as in claim 1, wherein said footwear further comprises an upper having at least one stay on each of the lateral and medial sides of said upper for guiding said lateral and medial strap portions, respectively, between said connectors, said medial and lateral strap portions slideably passing through said stays.

7. A self adjusting frame for footwear as in claim 1, wherein said plurality of connectors comprises a plurality of return loops; and wherein said medial and lateral strap portions are comprised of substantially flat webbing.

8. A self adjusting frame for footwear as in claim 1, further comprising a heel portion, said medial and lateral strap portions attached to said heel portion, whereby said heel portion is drawn forward upon said medial and lateral portions tightening.

9. A self adjusting frame for footwear as in claim 1, wherein said lateral and medial strap portions are affixed to said footwear adjacent said forefoot region of said footwear.

10. An article of footwear as in claim 6, further comprising a plurality of porous panels in the lateral and medial sides of said upper.

11. An article of footwear as in claim 10, wherein said porous panels comprise mesh material.

* * * * *